US008814532B2

(12) United States Patent
Ogata et al.

(10) Patent No.: US 8,814,532 B2
(45) Date of Patent: Aug. 26, 2014

(54) EJECTOR

(75) Inventors: Gouta Ogata, Nisshin (JP); Kazunori Mizutori, Toyohashi (JP); Masahiko Ikawa, Toyohashi (JP); Yasuhiro Tamatsu, Toyohashi (JP); Hiroki Nakagawa, Toyohashi (JP); Haruyuki Nishijima, Obu (JP); Mika Gocho, Obu (JP)

(73) Assignee: Denso Corporation, Kariya (JP)

( * ) Notice: Subject to any disclaimer, the term of this patent is extended or adjusted under 35 U.S.C. 154(b) by 480 days.

(21) Appl. No.: 13/065,695

(22) Filed: Mar. 28, 2011

(65) Prior Publication Data

US 2011/0236227 A1 Sep. 29, 2011

(30) Foreign Application Priority Data

Mar. 29, 2010 (JP) ..... 2010-75119

(51) Int. Cl.
*F04F 5/00* (2006.01)
*F04F 5/46* (2006.01)
*F04F 5/20* (2006.01)

(52) U.S. Cl.
CPC .... *F04F 5/20* (2013.01); *F04F 5/46* (2013.01)
USPC ..... 417/151; 417/194; 417/198

(58) Field of Classification Search
CPC ..... F04F 5/00; F04F 5/04; F04F 5/10; F04F 5/14; F04F 5/16; F04F 5/52; F04F 5/462; F04F 5/24; F04F 5/461; F25B 1/06; F25B 1/08
USPC ..... 417/151, 79, 171, 194–198
See application file for complete search history.

(56) References Cited

U.S. PATENT DOCUMENTS

| | | | | | |
|---|---|---|---|---|---|
| 265,246 | A | * | 10/1882 | Conord | 417/198 |
| 2,040,890 | A | * | 5/1936 | Wrentmore | 417/197 |
| 2,100,185 | A | * | 11/1937 | Engstrand | 417/170 |
| 2,396,290 | A | * | 3/1946 | Schwarz | 417/170 |
| 3,166,020 | A | * | 1/1965 | Cook | 417/198 |

(Continued)

FOREIGN PATENT DOCUMENTS

| | | |
|---|---|---|
| CN | 101592168 | 12/2009 |
| JP | 3-107596 | 5/1991 |
| JP | 2003-326196 | 11/2003 |
| JP | 2006-132897 | 5/2006 |
| JP | 2007-253175 | 10/2007 |
| JP | 2008-151017 | 7/2008 |

OTHER PUBLICATIONS

Office action dated Mar. 19, 2013 in corresponding Japanese Application No. 2010-075119 with English translation.
Office Action issued Jul. 1, 2013 in corresponding Chinese Application No. 201110076980.X (with English translation).

*Primary Examiner* — Devon Kramer
*Assistant Examiner* — Joseph Herrmann
(74) *Attorney, Agent, or Firm* — Harness, Dickey & Pierce, P.L.C.

(57) ABSTRACT

A nozzle of an ejector depressurizes and injects fluid, which is supplied to the nozzle. The nozzle is received in a receiving space of a body. The nozzle and the body are formed by press working. The nozzle includes nozzle-side ribs, which extend in an axial direction and project radially outward. The body includes body-side ribs, which extend in the axial direction and project radially outward. In a predetermined cross section of each of the nozzle and the body, which is perpendicular to the axial direction and includes the corresponding ribs, the nozzle or the body is formed seamlessly as a continuous single piece member.

13 Claims, 5 Drawing Sheets

(56) References Cited

U.S. PATENT DOCUMENTS

| | | | | |
|---|---|---|---|---|
| 4,595,344 | A * | 6/1986 | Briley | 417/185 |
| 5,309,736 | A * | 5/1994 | Kowalski et al. | 62/500 |
| 6,877,960 | B1 * | 4/2005 | Presz et al. | 417/198 |
| 7,165,948 | B2 | 1/2007 | Takeuchi et al. | |
| 7,438,535 | B2 * | 10/2008 | Morishima | 417/187 |
| 2006/0119101 | A1 * | 6/2006 | Suzuki et al. | 285/399 |
| 2009/0297367 | A1 | 12/2009 | Yamada et al. | |

* cited by examiner

EJECTOR

CROSS REFERENCE TO RELATED APPLICATION

This application is based on and incorporates herein by reference Japanese Patent Application No. 2010-75119 filed on Mar. 29, 2010.

BACKGROUND OF THE INVENTION

1. Field of the Invention

The present invention relates to an ejector.

2. Description of Related Art

In a known ejector, fluid is drawn through a fluid suction opening by an action of an injected high speed fluid, which is injected from a nozzle of the ejector. Then, the drawn fluid and the injected fluid are mixed together in the ejector, and a velocity energy of a mixture of the drawn fluid and the injected fluid is converted into a pressure energy at a pressurizing portion (diffuser) of the ejector to increase the pressure of the mixture, so that the pressure of the mixed fluid is increased.

This kind of ejector is used in wide variety of products, such as a refrigeration cycle system or a vacuum pump, to serve as a fluid depressurizing means for depressurizing the fluid through the nozzle of the ejector or a fluid transferring means for transferring the fluid by drawing the fluid through the fluid suction opening of the ejector. Therefore, it has been demanded to mass-produce an ejector of a specified size, which can implement an appropriate performance suitable for an intended use of the product having such an ejector, at low costs and within a short period of manufacturing time.

Japanese Unexamined Patent Publication No. 2003-326196 (U.S. Pat. No. 7,165,948B2) teaches manufacturing of a nozzle of an ejector through sintering of metal powder or ceramic powder. Furthermore, Japanese Unexamined Patent Publication No. 2003-326196 (U.S. Pat. No. 7,165,948B2) and Japanese Unexamined Patent Publication No. 2006-132897 (US 2006/0119101A1) teach a tubular body of the ejector, which is formed by processing a metal tube to form corresponding large and small diameter portions by enlarging or reducing a diameter of the metal tube through plastic deformation of the metal tube. This tubular body receives the nozzle and forms a fluid suction opening and a diffuser. Furthermore, Japanese Unexamined Patent Publication No. 2007-253175 teaches manufacturing of the body through a cold forging process.

When the nozzle is formed by the sintering in the manner recited in Japanese Unexamined Patent Publication No. 2003-326196 (U.S. Pat. No. 7,165,948B2), the manufacturing costs can be reduced in comparison to a case where the nozzle is formed through a cutting process. However, the reduction of the manufacturing costs of the nozzle formed through the sintering process is smaller than the reduction of the manufacturing costs of the nozzle formed through the plastic deformation process, such as the above discussed process of forming the large and small diameter portions in the metal tube through the plastic deformation. Furthermore, in the case where the cold forging process, which is recited in Japanese Unexamined Patent Publication No. 2007-253175, is employed, although the manufacturing process can be reduced, the manufacturing time is lengthened in comparison to the above discussed process of forming the large and small diameter portions in the metal tube through the plastic deformation.

Therefore, it is desirable to use the process of forming the large and small diameter portions by the plastic deformation recited in Japanese Unexamined Patent Publication No. 2003-326196 (U.S. Pat. No. 7,165,948B2) and Japanese Unexamined Patent Publication No. 2006-132897 (US 2006/0119101A1) among the above described techniques in order to, implement the reduced manufacturing costs, the reduced manufacturing time and the mass production of the ejector.

However, in the case where the metal tube is processed through the process of forming the large and small diameter portions by the plastic deformation of the metal tube, a wall thickness of the stretched portion, which is stretched by the enlarging or reducing of the diameter of the metal tube, becomes small. Therefore, in order to achieve a predetermined strength in the manufactured nozzle or the manufactured body, the amount of enlarging or reducing the diameter of the metal tube must be appropriately limited. Therefore, the manufacturable shape of the ejector is narrowly limited in the case of the process of forming the large and small diameter portions by the plastic deformation of the metal tube discussed in the above-described documents. As a result, it may be difficult to form the ejector of desired sizes.

SUMMARY OF THE INVENTION

The present invention addresses the above disadvantages. Thus, it is an objective of the present invention to provide an ejector, which can be manufactured to suit in a wide variety of applications and is suitable for a mass production.

According to the present invention, there is provided an ejector, which includes a nozzle and a body. The nozzle is adapted to depressurize and inject fluid, which is supplied to the nozzle. The body includes a fluid suction opening and a pressurizing portion. The fluid suction opening is adapted to draw fluid by an action of the injected fluid, which is injected at a high velocity from the nozzle. The pressurizing portion is adapted to mix the injected fluid, which is injected from the nozzle, and the drawn fluid, which is drawn through the fluid suction opening, such that a mixture of the injected fluid and the drawn fluid is pressurized through the pressurizing portion. At least one of the nozzle and the body is formed by press working. The at least one of the nozzle and the body, which is formed by the press working, has a rib that extends in an axial direction of the nozzle and projects radially outward. In a predetermined cross section of the at least one of the nozzle and the body, which is perpendicular to the axial direction and includes the rib, the at least one of the nozzle and the body is formed seamlessly as a continuous single piece member.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
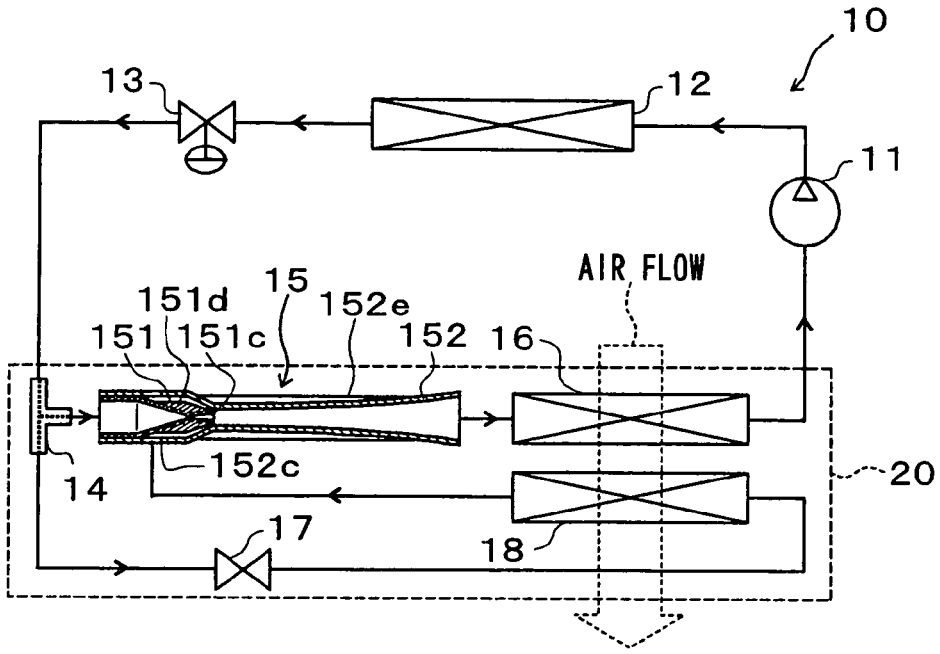
FIG. 1 is a schematic diagram showing an entire structure of an ejector refrigeration cycle, in which an ejector of an embodiment of the present invention is applied.

An embodiment of the present invention will be described with reference to FIGS. 1 to 7. In the present embodiment, an ejector 15 is applied to an ejector refrigeration cycle shown in FIG. 1. The ejector refrigeration cycle 10 is applied to an air conditioning system and cools the air to be blown into a room. FIG. 1 is a schematic diagram showing an entire structure of the ejector refrigeration cycle 10 of the present embodiment.

The ejector refrigeration cycle 10 includes a compressor 11, a radiator 12, an outflow-side evaporator 16 and a suction-side evaporator 18. The compressor 11 compresses and discharges refrigerant (fluid) upon drawing the same. The radiator 12 cools the high pressure refrigerant, which is discharged from the compressor 11, through heat exchange with outside air. At the outflow-side evaporator 16, the refrigerant, which is outputted from the ejector 15, is evaporated and is outputted from the outflow-side evaporator 16 toward an inlet of the compressor 11. At the suction-side evaporator 18, the refrigerant, which is outputted from a fixed choke (fixed restrictor) 17 having a fixed passage opening degree, is evaporated and is then outputted from the suction-side evaporator 18 toward a plurality of refrigerant suction openings 152*c* of the ejector 15.

Furthermore, the ejector refrigeration cycle 10 of the present embodiment further includes an expansion valve 13 and a branch portion 14. The expansion valve 13 depressurizes the refrigerant, which is outputted from the radiator 12, to an intermediate pressure. The branch portion 14 divides the flow of the refrigerant, which is depressurized through the expansion valve 13. The expansion valve 13 is a thermostatic expansion valve of a known type and adjusts a flow quantity of the refrigerant, which is passed through the expansion valve 13 toward the downstream side, such that a degree of superheat of the refrigerant at the outlet of the outflow-side evaporator 16 is kept within a predetermined range.

The branch portion 14 forms a three-way coupling structure, which has three fluid inlet/outlet openings. One of the three fluid inlet/outlet openings is a refrigerant flow inlet opening, and the remaining two of the three inlet/outlet openings are refrigerant flow outlet openings. One of the refrigerant flow outlet openings of the branch portion 14 is connected to a refrigerant inlet of a nozzle 151 of the ejector 15, and the other one of the refrigerant flow outlet openings of the branch portion 14 is connected to a refrigerant inlet of the fixed choke 17. For instance, an orifice or a capillary tube may be used as the fixed choke 17.

A refrigerant inlet of the outflow-side evaporator 16 is connected to a refrigerant outlet of the ejector 15 (specifically, a refrigerant outlet of a body 152 discussed below), and a refrigerant inlet of the compressor 11 is connected to a refrigerant outlet of the outflow-side evaporator 16. The refrigerant inlet of the suction-side evaporator 18 is connected to a refrigerant outlet of the fixed choke 17. The refrigerant suction openings 152*c*, which are formed in the body 152 of the ejector 15, are connected to a refrigerant outlet of the suction-side evaporator 18.

Furthermore, the components (specifically, the branch portion 14, the ejector 15, the outflow-side evaporator 16, the fixed choke 17 and the suction-side evaporator 18) of the ejector refrigeration cycle 10, which are located within a dotted rectangular line in FIG. 1, are integrally formed as an evaporator unit 20.

More specifically, in the present embodiment, each of, the outflow-side evaporator 16 and the suction-side evaporator 18 is formed as a tank-and-tube heat exchanger, which includes a plurality of tubes and two tanks, more specifically a distribution tank and a collection tank (also referred to as distribution/collection tanks). The tubes conduct the refrigerant therethrough. The distribution tank is connected to one ends of the tubes to distribute the refrigerant into the tubes, and the collection tank is connected to the other ends of the tubes to collect the refrigerant from the tubes.

In the present embodiment, the outflow-side evaporator 16 and the suction-side evaporator 18 are integrally formed together such that corresponding two (upper two) of the distribution/collection tanks of the evaporators 16, 18 are formed together, and other corresponding two (lower two) of the distribution/collection tanks of the evaporators 16, 18 are formed together. Here, the outflow-side evaporator 16 and the suction-side evaporator 18 are placed in a series in the flow direction of the blown air, i.e., are placed one after another in the flow direction of the blown air such that the outflow-side evaporator 16 is located on an upstream side of the suction-side evaporator 18 in the flow direction of the blown air.

The ejector 15 is placed in and integrated in one of the distribution/collection tanks of the evaporators 16, 18 or is placed in and integrated in a separate tank, which is separate from the distribution/collection tanks of the evaporators 16, 18. The ejector 15 is placed to extend in parallel with a longitudinal direction of the distribution/collection tanks of the evaporators 16, 18. The ejector 15 is soldered to an inner wall surface of the corresponding one of the distribution/collection tanks of the evaporators 16, 18 or of the separate tank. The branch portion 14 and the fixed choke 17 are also integrated to the evaporators 16, 18 by, for example, soldering (bonding means) or bolts (mechanical engaging means).

Next, the structure of the ejector 15 will be described in detail with reference to FIGS. 2 to 4. In the ejector refrigeration cycle 10, the ejector 15 of the present embodiment serves as a refrigerant depressurizing means for depressurizing the refrigerant, which is divided at the branch portion 14 and has the intermediate pressure; and also serves as a refrigerant transferring means (refrigerant circulating means) for transferring (circulating) the refrigerant by suctioning the refrigerant through the suctioning action of the high speed refrigerant flow, which is injected at a high speed.

Figure 2:
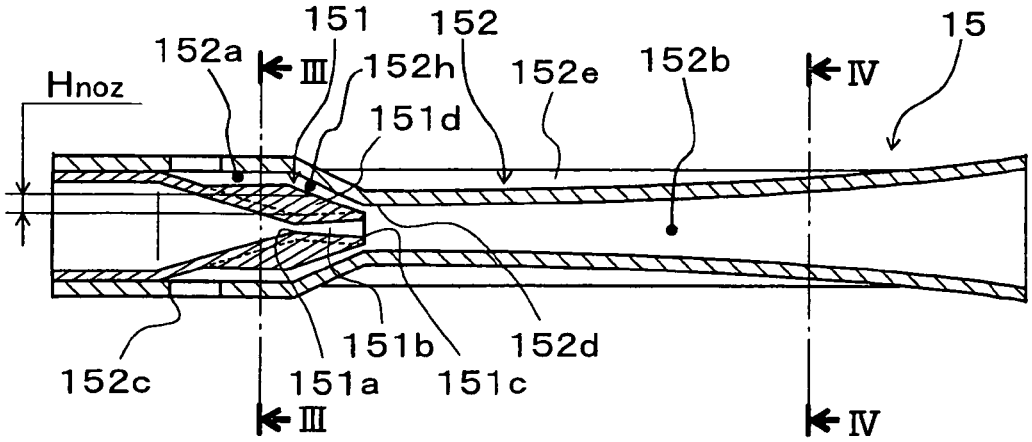
FIG. 2 is a longitudinal cross-sectional view of the ejector of the embodiment.

FIG. 2 is a longitudinal cross section (axial cross section) of the ejector 15. FIG. 3 is an enlarged cross-sectional view taken along line in FIG. 2, and FIG. 4 is an enlarged cross-sectional view take along line IV-IV in FIG. 2.

As shown in FIG. 2, the ejector 15 includes the nozzle 151 and the body 152. The nozzle 151 is formed through a press-working process (or simply referred to as press working) of a cylindrical tubular preform, which is made of metal (stainless alloy in this embodiment) and is configured into a cylindrical tubular form. The nozzle 151 has a tapered distal end portion, which is tapered toward a downstream side in the flow direction of the refrigerant. A cross-sectional area (refrigerant passage cross-sectional area) of the refrigerant passage, which is formed in the inside of the nozzle 151, varies along its length to isentropically depressurize the refrigerant.

Specifically, the refrigerant passage, which is formed in the inside of the nozzle 151, includes a throat portion 151*a* and a diverging portion 151*b*. The refrigerant passage cross-sectional area of the throat portion 151*a* is minimized in the refrigerant passage of the nozzle 151, and the refrigerant passage cross-sectional area of the diverging portion 151*b* progressively increases from the throat portion 151*a* toward the downstream side in the flow direction of the refrigerant. That is, the nozzle 151 is formed as a Laval nozzle, and the flow speed of the refrigerant at the throat portion 151*a* is equal to or higher than the sonic speed. Here, it should be noted that a convergent nozzle may be used as the nozzle 151.

As shown in FIG. 2, a refrigerant injection opening 151*c*, from which the refrigerant is injected, is formed in the tapered distal end portion of the nozzle 151. Furthermore, as shown in FIGS. 2 and 3, a plurality (two in this embodiment) of nozzle-side ribs 151*d* is formed in the nozzle 151 to extend, i.e., elongate in the axial direction and to project radially outward. The nozzle-side ribs 151*d* are arranged one after another at generally equal intervals (180 degree intervals in the present embodiment) in the circumferential direction of the nozzle 151.

Each of the nozzle-side ribs 151*d* is formed by applying a load to a corresponding excessive wall portion of the cylindrical tubular preform (a wall portion that does not define the refrigerant passage in the inside of the nozzle 151 in the final product) from opposite circumferential sides thereof on the radially outer side of the cylindrical tubular preform to fold the corresponding excessive wall portion of the cylindrical tubular preform into a form of a mountain fold, which radially outwardly projects, in the press-working process. Thereby, two circumferentially opposed contact surfaces 151*f*, 151*g* of each nozzle-side rib 151*d*, which radially outwardly extend from the inner peripheral surface of the nozzle 151, are circumferentially urged against each other, as shown in FIG. 3. FIG. 3 shows a cross-section of the nozzle 151, which is perpendicular to the axial direction of the nozzle 151 and is located at an axial location where the nozzle-side ribs 151*d* are placed, and this plane of the nozzle 151 shown FIG. 3 serves as a reference cross section (predetermined cross section) of the nozzle 151.

Figure 3:
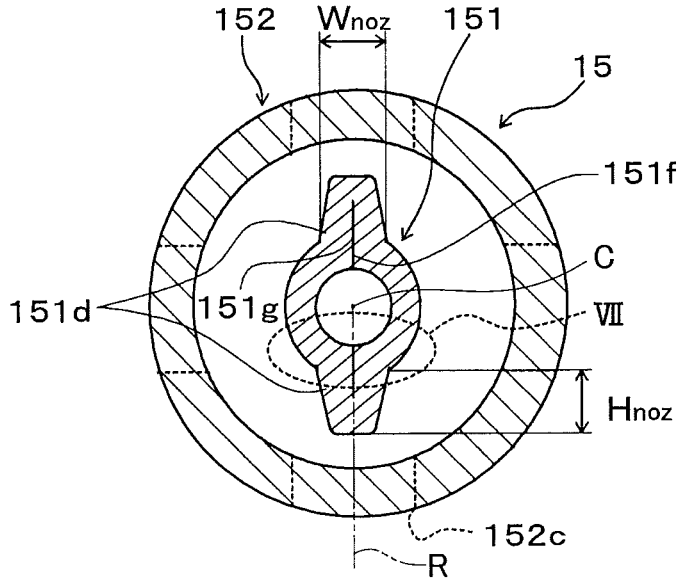
FIG. 3 is an enlarged cross sectional view taken along line III-III in FIG. 2.

Furthermore; in the reference cross section of the nozzle 151 shown in FIG. 3, each nozzle-side rib 151*d* is configured into a trapezoidal form, and a circumferential width Wnoz of the nozzle-side rib 151*d* progressively decreases toward a radially outer end of the nozzle-side rib 151*d*. The width Wnoz of the nozzle-side rib 151*d* can be defined as a circumferential thickness of the nozzle-side rib 151*d*, which is measured in a direction parallel to an imaginary line, which connects between two base ends of the nozzle-side rib 151*d*.

Furthermore; as shown in FIGS. 2 and 3, a radially outermost part (radially outermost surface) of the nozzle-side rib 151*d* (a radial distal end part of the nozzle-side rib 151*d*) is located radially inward of a radially outermost part (radially outermost surface) of the nozzle 151 (a largest outer diameter part of the nozzle 151 having a largest outer diameter in the nozzle 151). In other words, a radial height Hnoz of the nozzle-side rib 151*d* is set such that the radially outermost part of the nozzle-side rib 151*d* is radially placed within an imaginary cylindrical space, which is formed by axially extending an outer peripheral surface of the radially outermost part of the nozzle 151 (the largest outer diameter part of the nozzle 151).

Furthermore, as shown in FIG. 2, a radial height Hnoz of a downstream side portion of each nozzle-side rib 151*d*, which is located adjacent to the refrigerant injection opening 151*c*, progressively decreases toward the downstream side in the flow direction of the refrigerant. Also, as is obvious from FIG. 3, the nozzle 151 is formed from the single continuous seamless annular member (seamless tubular member) without using a plurality of members joined together.

Similar to the nozzle 151, the body 152 is formed into a cylindrical tubular body through a press-working process of a cylindrical tubular preform, which is made of metal (aluminum material in the present embodiment) and is configured into a cylindrical tubular form. A receiving space 152*a* and a pressurizing space 152*b* are formed in the inside of the body 152. The receiving space 152*a* receives the nozzle 151, and the pressurizing space 152*b* forms a pressurizing portion (diffuser portion):

More specifically, a downstream side portion of the receiving space 152*a*, which is located on the downstream side in the flow direction of the refrigerant, converges such that a cross section of the downstream side portion of the receiving space 152*a*, which is perpendicular to the axial direction, progressively decreases toward the downstream side in flow direction of the refrigerant. In contrast, the pressurizing space 152*b* diverges such that a cross section of the pressurizing space 152*b*, which is perpendicular to the axial direction, progressively increases toward the downstream side in the flow direction of the refrigerant.

In the present embodiment, the number of the refrigerant suction openings 152*c* is four, and these refrigerant suction openings 152*c* radially penetrate through the wall of the body 152 at the receiving space 152*a* of the body 152. The refrigerant suction openings 152*c* are arranged one after another along the wall of the body 152 at generally equal intervals in the circumferential direction (at 90 degree intervals in the present embodiment). The refrigerant suction openings 152*c* are through holes that guide the refrigerant, which is, outputted from the suction-side evaporator 18, into the receiving space 152*a*. These refrigerant suction openings 152*c* of the body 152 are placed radially outward of the nozzle 151 and are communicated with the refrigerant injection opening 151*c* of the nozzle 151.

Therefore, an inlet space is formed in the receiving space 152*a* at a location around the refrigerant suction openings 152*c* to receive the refrigerant. A suction passage 152*h* is formed in a space that is radially defined between the outer peripheral wall of the tapered distal end portion of the nozzle 151 and the inner peripheral wall of the body 152. The suction passage 152*h* guides the refrigerant, which is drawn into the receiving space 152*a*, to the pressurizing space 152*b*.

As shown in FIG. 2, the pressurizing space 152*b* is placed on the downstream side of the nozzle 151 and the refrigerant suction openings 152*c* and serves as the diffuser portion. In this diffuser portion, the refrigerant, which is injected from the nozzle 151, is mixed with the refrigerant, which is drawn through the refrigerant suction openings 152*c*, to form a mixture (mixed refrigerant), and at the same time, the kinetic energy of the mixture is converted into a pressure energy.

Furthermore, a straight portion 152*d*, which has a fluid passage cross section that is generally constant along an axial length of the straight portion 152*d*, is formed in a connecting portion, which connects between the downstream side portion of the receiving space 152*a* and the upstream side portion of the pressurizing space 152*b*. Furthermore, as shown in FIG. 2, the shape of the pressurizing space 152*b* (i.e., the shape defined by the inner peripheral wall surface of the body 152) in the longitudinal cross section (axial cross section) of the body 152 varies along the axial length of the pressurizing space 152*b* to form a curved profile.

Specifically, a degree of increase in the refrigerant passage cross-sectional area at the inlet side portion of the pressurizing space 152*b* is smaller than a degree of increase in the refrigerant passage cross-sectional area at the outlet side portion of the pressurizing space 152*b*. In other words, the shape of the pressurizing space 152*b* in the longitudinal cross section of the body 152 is curved such that the shape of the pressurizing space 152*b* is radially inwardly convex.

Figure 4:
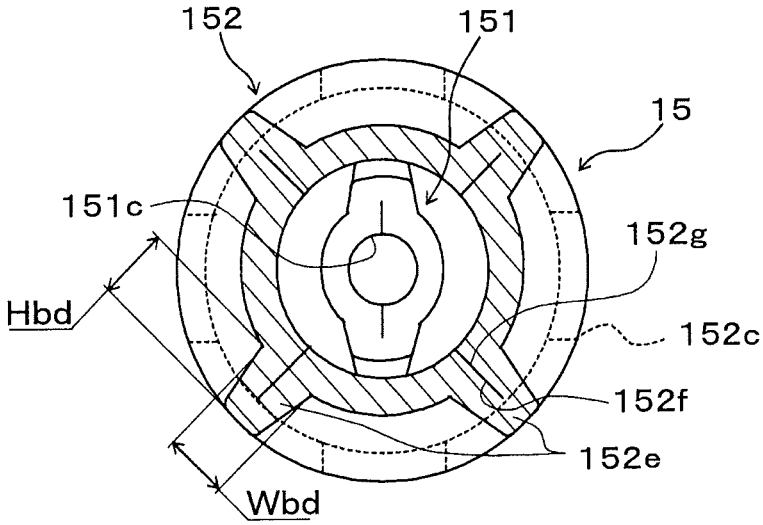
FIG. 4 is a cross sectional view taken along line IV-IV in FIG. 2.

Furthermore, as shown in FIGS. 2 and 4, a plurality (four in this embodiment) of body-side ribs 152*e* is formed in the body 152 to extend, i.e., elongate in the axial direction and to project radially outward such that the body-side ribs 152*e* are arranged one after another at generally equal intervals (90 degree intervals in the present embodiment) in the circumferential direction of the body 152. Similar to the nozzle-side ribs 151*d*, each of the body-side ribs 152*e* is formed by applying a load to a corresponding excessive wall portion of the cylindrical tubular preform (a wall portion that does not define the refrigerant passage in the inside of the body 152 in the final product) from opposite circumferential sides thereof on the radially outer side of the cylindrical tubular preform to fold the corresponding excessive wall portion of the cylindrical tubular preform into a form of a mountain fold, which radially outwardly projects, in the press-working process. Thereby, as shown in FIG. 4, two circumferentially opposed contact surfaces 152*f*, 152*g* of each body-side rib 152*e*, which radially outwardly extend from the inner peripheral surface of the body 152, are circumferentially urged against each other.

Here, FIG. 4 shows a cross-section of the body 152, which is perpendicular to the axial direction and is located at an axial location where the body-side ribs 152*e* are placed, and this plane of the body 152 shown FIG. 4 serves as a reference cross section (predetermined cross section) of the body 152. According to the present embodiment, in the longitudinal cross section of the body 152 shown in FIG. 2, the body-side ribs 152*e* are formed in the corresponding axial location, which does not overlap with the axial location, in which the refrigerant suction openings 152*c* are formed. Furthermore, the reference cross section is a cross section, which does not include the refrigerant suction openings 152*c*.

Furthermore, similar to the nozzle-side ribs 151*d*, in the reference cross section of FIG. 4, each body-side rib 152*e* is configured into a trapezoidal form, and a circumferential width Wbd of this trapezoidal form of the body-side rib 152*e* progressively decreases toward the radially outer end of the body-side rib 152*e*. A radial height Hbd of the body-side rib 152*e* is set such that a radial location of a radially outermost part (radially outermost end surface) of the body-side rib 152*e* (a radial distal end part of the body-side rib 152*e*) is generally the same as a radial location of the radially outermost part (radially outermost end surface) of the body 152 (the largest outer diameter part of the body 152 having the largest outer diameter in the body 152).

Furthermore, as is obvious from FIG. 4, the body 152 is formed from the single continuous seamless annular member (seamless tubular member), i.e., is not formed from a plurality of members.

Next, the operation of the ejector refrigeration cycle 10 will be described. When the compressor 11 is driven, the compressor 11 compresses and discharges the refrigerant upon drawing the same. The high temperature and high pressure refrigerant, which is discharged from the compressor 11, releases the heat at the radiator 12. The high pressure refrigerant, which has released its heat at the radiator 12, is depressurized and is expanded at the expansion valve 13.

At this time, the degree of opening of the expansion valve 13 (the refrigerant flow quantity) is adjusted such that the degree of superheat of the refrigerant at the outlet of the outflow-side evaporator 16 (the refrigerant to be drawn into the compressor 11) substantially coincides with a predetermined value. The flow of the refrigerant, which has been depressed and expanded at the expansion valve 13 and now has an intermediate pressure, is divided at the branch portion 14 into the refrigerant flow directed to the nozzle 151 of the ejector 15 and the refrigerant flow directed to the fixed choke 17.

The refrigerant, which is supplied to the nozzle 151 of the ejector 15, is isentropically depressurized and expanded through the nozzle 151 and is injected from the refrigerant injection opening 151*c* as the high speed refrigerant flow. The refrigerant, which is outputted from the suction-side evaporator 18, is drawn into the refrigerant suction openings 152*c* through the suctioning action of the high speed refrigerant flow, which is injected from the refrigerant injection opening 151*c*.

The injected refrigerant, which is injected from the nozzle 151, and the drawn refrigerant, which is drawn through the refrigerant suction openings 152*c*, are guided into the pressurizing space 152*b*, which forms the diffuser portion. At the pressurizing space 152*b*, the injected refrigerant and the drawn refrigerant are mixed together, and the velocity energy of the refrigerant is converted into the pressure energy because of the progressive increase in the refrigerant passage cross-sectional area. Thereby, the pressure of the refrigerant is increased. The refrigerant, which is discharged from the ejector 15 (specifically, the pressurizing portion), is supplied to the outflow-side evaporator 16.

In the outflow-side evaporator 16, the supplied low pressure refrigerant absorbs the heat from the blown air, which is blown toward the room through the outflow-side evaporator 16, so that the refrigerant is evaporated. In this way, the blown air, which is directed toward the room, is cooled. Then, the gas phase refrigerant, which is discharged from the outflow-side evaporator 16, is drawn into the compressor 11 and is compressed once again.

The refrigerant, which is directed from the branch portion 14 toward the fixed choke 17, is isenthalpically depressurized and expanded through the fixed choke 17 and is then supplied to the suction-side evaporator 18. The refrigerant, which is supplied to the suction-side evaporator 18, absorbs the heat from the blown air, which is blown toward the room through the suction-side evaporator 18, and thereby the refrigerant is evaporated. In this way, the blown air, which is blown toward the room, is further cooled and is blown to the room. The refrigerant, which is outputted from the suction-side evaporator 18, is drawn into the ejector 15 through the refrigerant suction openings 152*c*.

As described above, in the ejector refrigeration cycle 10 of the present embodiment, the blown air, which is blown toward the room, is passed through the outflow-side evaporator 16 and the suction-side evaporator 18 in this order to cool the common cooling subject space (room). At this time, the refrigerant evaporation temperature of the outflow-side evaporator 16 can be increased beyond the refrigerant evaporation temperature of the suction-side evaporator 18. Therefore, it is possible to effectively cool the blown air through use of a temperature difference between the refrigerant evaporation temperature of the outflow-side evaporator 16 and the temperature of the blown air and a temperature difference between the refrigerant evaporation temperature of the suction-side evaporator 18 and the temperature of the blown air.

Furthermore, the downstream side of the outflow-side evaporator 16 is connected to the inlet of the compressor 11. Therefore, the refrigerant, which is pressurized at the pressurizing portion (pressurizing space 152*b*), can be drawn into the compressor 11. As a result, the inlet pressure of the compressor 11 is increased to reduce the drive power of the compressor 11. Therefore, the coefficient of performance (COP) of the cycle can be improved.

Next, the manufacturing method of the ejector 15 of the present embodiment will be described with reference to FIGS. 5A to 6H. FIGS. 5A to 5H are diagrams for describing a manufacturing process of the nozzle 151, and FIGS. 6A to 6H are diagrams for describing a manufacturing process of the body 152.

Figure 5A:
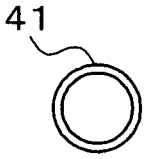
FIGS. 5A to 5H are diagrams for describing manufacturing steps of a nozzle of the ejector of the embodiment.
Figure 5B:
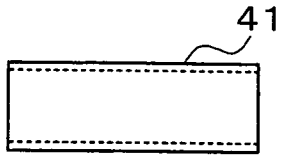

First of all, at the time of manufacturing the nozzle 151, a nozzle preform 41, which is preformed into a cylindrical tubular form to form the nozzle 151 at the press forming process (or simply referred to as press forming), is prepared at a nozzle preform preparing step shown in FIGS. 5A and 5B. FIG. 5A is an end view of the nozzle preform 41, and FIG. 5B is a front view of the nozzle preform 41. In the present embodiment, a planar plate, which is made of metal (a stainless alloy in this instance), is configured into a cup shaped cylindrical tubular body (i.e., a cylindrical tubular body having a bottom, which closes one end of the cylindrical tubular body) through a deep-drawing process, and the thus produced body is used as the nozzle preform 41 shown in FIGS. 5A and 5B.

Figure 5C:
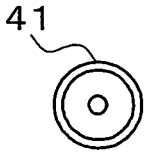
Figure 5D:
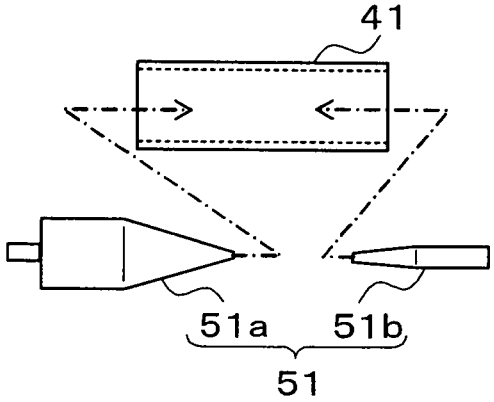

Next, at a nozzle plug inserting step shown in FIGS. 5C and 5D, a nozzle plug 51 is inserted into an inside space of the nozzle preform 41, which is prepared at the nozzle preform preparing step. An outer shape of the nozzle plug 51 is substantially identical to that of the refrigerant passage of, the nozzle 151. As discussed above, the nozzle 151 of the present embodiment is formed as the Laval nozzle. Therefore, a through hole is formed in the bottom surface of the nozzle preform 41 in advance. Then, divided nozzle plugs 51*a*, 51*b*, which form the nozzle plug 51, are inserted from opposed ends, respectively, of the nozzle preform 41. FIG. 5C is an end view of the nozzle preform 41, into which the nozzle plugs 51*a*, 51*b* are inserted, and FIG. 5D is a front view of the nozzle preform 41, into which the nozzle plugs 51*a*, 51*b* are inserted.

In this way, after completion of the press working process, the nozzle plugs 51*a*, 51*b* can be easily removed from the opposed ends, respectively, of the nozzle preform 41. In the case where the nozzle 151 is formed as the tapered nozzle, the nozzle plug 51, which is made as a single piece, may be inserted into the nozzle preform 41 through the open end of the nozzle preform 41. Furthermore, it is desirable that the nozzle plug 51 is made of, for example, a ultra-hard-steel material, which has a high hardness, to configure the refrigerant passage of the nozzle 151 into a desired size.

Figure 5E:
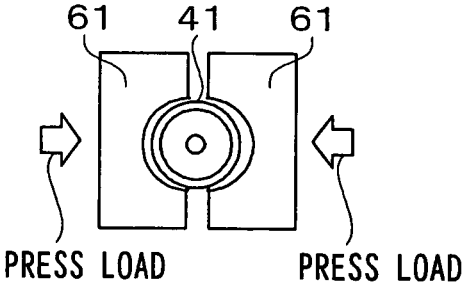
Figure 5F:
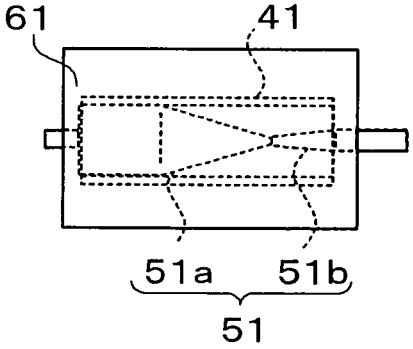

Next, the nozzle preform 41, in which the nozzle plug 51 is inserted through the nozzle plug inserting step, is radially inwardly pressed in the radial direction, which is perpendicular to the axial direction of the nozzle 151, with press dies 61 at a press working process shown in FIGS. 5E and 5F. Here, the number of the press dies 61 is the same (two in this embodiment) as that of the nozzle-side ribs 151*d*, and the nozzle-side ribs 151*d* are formed between the adjacent press dies 61. FIG. 5E is an end view showing the nozzle preform 41 placed in the press dies 61, and FIG. 5F is a front view showing the nozzle preform 41 placed in the press dies 61.

Figure 5G:
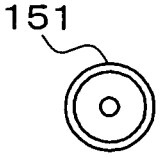
Figure 5H:
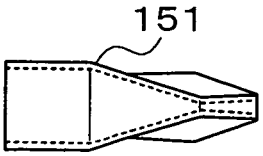

Thereafter, the nozzle plug 51 (i.e., the nozzle plugs 51*a*, 51*b*) is removed from the nozzle 151, which is formed by the press working process of the nozzle, so that the nozzle 151 is produced, as shown in FIGS. 5G and 5H. FIG. 5G is an end view of the nozzle 151, and FIG. 5H is a front view of the nozzle 151. In the case where the nozzle 151 is formed as the tapered nozzle, the through hole may be formed in the bottom surface of the nozzle preform 41 after the press working step of the nozzle. Also, similar to the case where the nozzle 151 is formed as the Laval nozzle, the through hole may be formed in the bottom surface of the nozzle preform 41 at the nozzle plug inserting step.

Figure 6A:
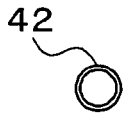
FIGS. 6A to 6H are diagrams for describing manufacturing steps of a body of the ejector of the embodiment.
Figure 6B:
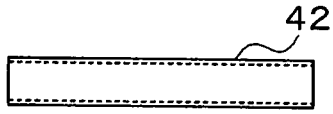

Furthermore, as shown in FIGS. 6A to 6H, at the time of manufacturing the body 152, the body 152 is manufactured in a manner similar to that of the nozzle 151. First of all, a body preform 42, which is later configured into a cylindrical tubular form to form the body 152 through the press forming process, is prepared at a body preform preparing step shown in FIGS. 6A and 6B. In the present embodiment, a tube (also called tubing) made of aluminum is used as the body preform 42. FIG. 6A is an end view of the body preform 42, and FIG. 6B is a front view of the body preform 42.

Figure 6C:
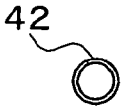
Figure 6D:
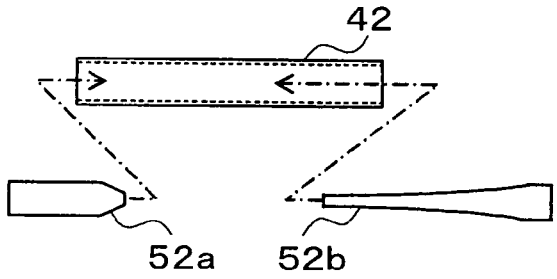

Next, at a body plug inserting step shown in FIGS. 6C and 6D, a body plug 52*a*, which has an outer shape that substantially identical to that of the receiving space 152*a*, is inserted into the inside space of the body preform 42, which is prepared at the body preform preparing step, from the one end of the body preform 42. Also, a body plug 52*b*, which has an outer shape that substantially identical to that of the pressurizing space 152*b*, is inserted into the interior of the body preform 42 from the other end of the body preform 42. FIG. 6C is an end view of the body preform 42, into which the body plugs 52*a*, 52*b* are inserted, and FIG. 6D is a front view of the body preform 42, into which the body plugs 52*a*, 52*b* are inserted.

Figure 6E:
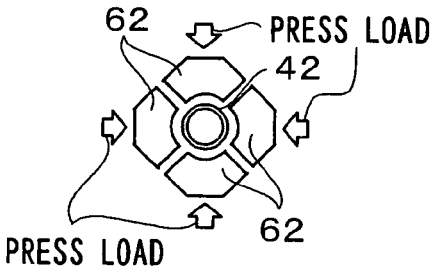
Figure 6F:
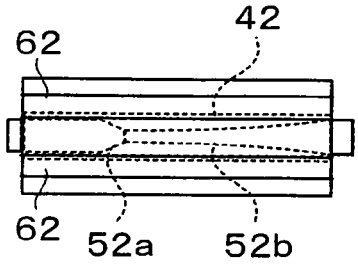

Next, the body preform 42, in which the body plugs 52*a*, 52*b* are inserted through the body plug inserting step, is radially inwardly pressed in the radial direction, which is perpendicular to the axial direction, with press dies 62 at a press working step of the body shown in FIGS. 6E and 6F. The number of the press dies 62 is the same (four in this embodiment) as that of the body-side ribs 152*e*. Each of the body-side ribs 152*e* is formed between corresponding adjacent two of the press dies 62. FIG. 6E is an end view showing the body preform 42 placed in the press dies 62, and FIG. 6F is a front view showing the body preform 42 placed in the press dies 62.

Next, the body plugs 52*a*, 52*b* are removed from the body 152, which is formed by the press working process of the body 152. Also, the refrigerant suction openings 152*c* are formed in the cylindrical surface of the body 152. Furthermore, the straight portion 152*d* is formed at the connecting portion between the receiving space 152*a* and the pressurizing space 152*b* in the inside of the body 152 (additional processing step of the body).

Figure 6G:
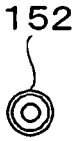
Figure 6H:
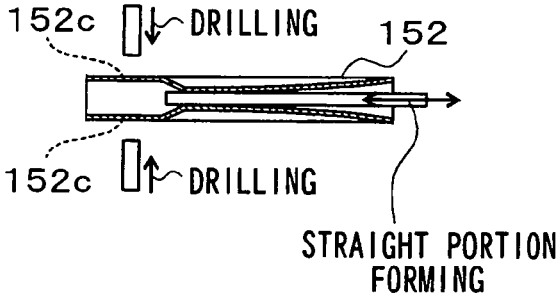

More specifically, with reference to FIGS. 6G and 6H, the refrigerant suction openings 152*c* are formed by a drilling process such that each of the refrigerant suction openings 152*c* is circumferentially placed at a corresponding location, which does not overlap with the body-side ribs 152*e* when the body 152 is viewed in the axial direction. Furthermore, the straight portion 152*d*, which is formed in the connecting portion between the receiving space 152*a* and the pressurizing space 152*b*, is formed by axially moving a cylindrical cutting tool in the inside of the body 152. FIG. 6G is an end view of the body 152, into which the cylindrical cutting tool is applied to form the straight portion 152*d*. FIG. 6H is a front view of the body 152, to which the cylindrical cutting tool is applied to form the straight portion 152*d*, and to which drill bits are applied to form the refrigerant suction openings 152*c*.

Next, the nozzle 151, which is formed in the above described manner, is received in the receiving space 152*a* of the body 152 and is temporarily fixed therein (temporal fixing step for temporarily fixing between the nozzle and the body). At this time, as shown in FIG. 3, when the body 152 and the nozzle 151 are viewed in the axial direction, each of the nozzle-side ribs 151*d* is circumferentially placed at a corresponding location, which overlaps with an imaginary radial line R that radially connects between the central axis C of the nozzle 151 and a circumferential center of the corresponding refrigerant suction opening 152*c* of the body 152.

In the present embodiment, the outer diameter of the largest outer diameter part of the nozzle 151, which is located at the refrigerant inlet of the nozzle 151, is slightly larger than the inner diameter of the receiving space 152*a* of the body 152, so that the largest outer diameter part of the nozzle 151 is close fitted into the receiving space 152*a*. In this way, the nozzle 151 is received in the receiving space 152*a*, and thereby the nozzle 151 is temporarily fixed to the body 152.

Furthermore, as discussed above, the ejector 15 of the present embodiment is received in the distribution/collection tank of the outflow-side evaporator 16 or the suction-side evaporator 18 or is received in the separate tank. Therefore, the ejector 15, which is in the temporarily fixed state upon the temporarily fixing the nozzle and the body together, is placed in and is temporarily fixed in the corresponding one of the distribution/collection tanks or the separate tank (temporarily fixing step of the ejector).

This temporal fixing is implemented as follows. That is, the outer diameter of the ejector 15 (specifically, the body 152) is made slightly larger than the inner diameter of the corresponding one of the distribution/collection tanks or of the separate tank, so that the ejector 15 (specifically, the body 152) is close fitted to the corresponding one of the distribution/collection tanks or the separate tank.

The outflow-side evaporator 16 and the suction-side evaporator 18, in each of which the ejector 15, the tubes, the distribution/collection tanks and/or the separate tank are temporarily fixed, are placed in a heating oven or furnace (serving as a heating means).

In this way, a brazing material, which is cladded over the outer peripheral surface of the nozzle 151, the inner and outer peripheral surfaces of the body 152 and the inner peripheral surface of the corresponding one of the distribution/collection tanks or of the separate tank, is melted. Then, the outflow-side evaporator 16 and the suction-side evaporator 18 are cooled until the brazing material discussed above is solidified once again. Thereby, the ejector 15 is manufactured, and the evaporator unit 20 is manufactured (ejector joining step).

Furthermore, in the present embodiment, the ejector 15, which is manufactured in the above described manner, is used, so that the advantages described below can be implemented.

In the present embodiment, the nozzle 151 and the body 152 are formed in the press working process, which is a kind of plastic working process. Therefore, in comparison to a case where the nozzle 151 and the body 152 are formed through a cutting process, it is possible to reduce the manufacturing costs and the manufacturing time. Specifically, the ejector 15 of the present embodiment is suitable for a mass production.

At the additional processing step of the body, the refrigerant suction openings 152*c* and the straight portion 152*d* are formed through the different processes, which are different from the press working process. However, these processes are simpler in comparison to the case where the nozzle 151 and the body 152 are entirely formed through the cutting process, and these processes will not have a substantial negative influence on the mass production of the ejector 15 of the present embodiment.

Furthermore, the nozzle-side ribs 151*d* and the body-side ribs 152*e* are formed in the nozzle 151 and the body 152, respectively. The nozzle-side ribs 151*d* and the body-side ribs 152*e* are formed from the excessive wall portions, respectively, of the nozzle preform 41 and of the body preform 42, which are excessive to the nozzle 151 or the body 152.

In this way, it is possible to limit formation of an extremely stretched thin wall portion in the nozzle 151 and the body 152 through the press working process. Therefore, it is possible to increase a range of manufacturable shapes of the ejector 15, and thereby the ejector 15 of the present embodiment can be configured into various specified sizes.

Furthermore, the nozzle-side ribs 151*d* and the body-side ribs 152*e*, which are formed through the press working process, extend in the axial direction of the nozzle 151 and project radially outward. Therefore, in comparison to a case where the excess wall portions, which form the nozzle-side ribs 151*d* or the body-side ribs 152*e* of the nozzle 151 or the body 152, radially inwardly project into the refrigerant passage defined in the inside of the nozzle 151 or the body 152, it is possible to avoid a deviation from the specified size of the cross-sectional area of the refrigerant passage, which is defined in the inside of the nozzle 151 or the body 152.

Furthermore, the nozzle-side ribs 151*d* and the body-side ribs 152*e* serve as reinforcing members of the nozzle 151 or the body 152 to limit the deformation of the nozzle 151 or the body 152.

Furthermore, in the reference cross section, each of the nozzle 151 and the body 152 is formed from the single continuous seamless annular member (seamless tubular member) without using the multiple members joined together. Therefore, it is not required to perform a joining process, which would be required to join the multiple members together to limit a leakage of the fluid, which passes through the inside of the nozzle 151 or the body 152. Therefore, the manufacturing costs of the ejector can be further reduced.

Figure 7:
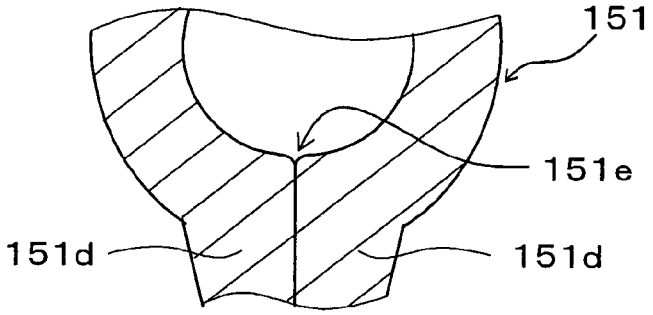
FIG. 7 is an enlarged partial view of a portion VII in FIG. 3.

When each of the nozzle-side ribs 151*d* and the body-side ribs 152*e* is formed by applying the load to the corresponding excessive wall portion of the cylindrical tubular preform 41, 42 from the opposite circumferential sides thereof on the radially outer side of the cylindrical tubular preform to fold the corresponding excessive wall portion of the cylindrical tubular preform into the form of the mountain fold, which radially outwardly projects, in the press-working process, a recess 151*e* is likely formed in the inner peripheral surface of the nozzle 151 or the body 152 at a location where the two circumferentially opposed contact surfaces 151*f*, 151*g* of the rib 151*d* (or the rib 152*e*) contact with each other, as shown in FIG. 7. FIG. 7 is an enlarged view of an area VII in FIG. 3 and serves as a diagram for describing the recess 151*e* of the nozzle-side rib 151*d*.

With respect to this point, the ejector 15 of the present embodiment is configured such that each of the nozzle-side ribs 151*d* and the body-side ribs 152*e* has the circumferential width Wnoz, Wbd which progressively decreases toward the radially outer end of the rib 151*d*, 152*e*. Therefore, at the time of performing the press working process, the load can be easily applied in the direction for decreasing the recess. Thus, the size of the recess 151*e* can be reduced, and thereby the shape of the ejector can be more closely adjusted to the specified desired size.

Also, as in the present embodiment, when the divided nozzle plugs 51*a*, 51*b* or the divided body plugs 52*a*, 52*b* are inserted into the corresponding preform 41, 42 at the nozzle plug inserting step or the body plug inserting step, the material of the preform 41, 42 may possibly enter a small gap between the contact surfaces of the divided nozzle plugs 51*a*, 51*b* or the divided body plugs 52*a*, 52*b* to form a burr.

Particularly, in the case of the body 152, which is formed by the press working of the preform 42 made of aluminum, which is softer than the stainless alloy, the burr of a relatively large size may possibly be formed to cause an energy loss of the refrigerant that flows in the inside of the body 152. With respect to this point, in the case of the ejector 15 of the present embodiment, the straight portion 152*d* is formed in the connecting portion between the receiving space 152*a* and the pressurizing space 152*b* at the additional processing step of the body. Therefore, the burr can be reliably removed.

Furthermore, at the additional processing step of the body 152 of the present embodiment, the refrigerant suction openings 152*c* are formed at the corresponding locations, which do not overlap with the body-side ribs 152*e*, i.e., which are circumferentially displaced from the body-side ribs 152*e* in the axial view of the body 152. Therefore, at the additional processing step of the body 152, the refrigerant suction openings 152*c* can be easily formed without being hindered by the body-side ribs 152*e*.

In addition, at the temporarily fixing step for temporarily fixing the nozzle 151, and the body 152 together, when the nozzle 151 is viewed in the axial direction of the nozzle 151, the nozzle-side ribs 151*d* are placed such that each nozzle-side rib 151*d* is overlapped with the imaginary radial line, which connects between the central axis of the nozzle 151 and the circumferential center of the corresponding one of the refrigerant suction openings 152*c*. Therefore, each nozzle-side rib 151*d* can be placed along the flow direction of the drawn refrigerant, which is drawn through the corresponding refrigerant suction opening 152*c*. Thereby, it is possible to reduce the pressure loss of the drawn refrigerant, which would be otherwise induced by the presence of nozzle-side ribs arranged differently from the nozzle-side ribs 151*d* of the present embodiment.

Furthermore, the radially outermost part (radially outermost surface) of the nozzle-side rib 151*d* (the radial distal end part of the nozzle-side rib 151*d*) of the present embodiment is placed radially inward of the radially outermost part (radially outermost surface) of the nozzle 151 (the largest outer diameter part of the nozzle 151 having the largest outer diameter in the nozzle 151). Therefore, at the temporarily fixing step of the nozzle 151 and the body 152, the nozzle-side ribs 151*d* will not contact the inner peripheral surface of the body 152, so that the nozzle 151 can be easily received in the body 152.

Furthermore, the radial height Hnoz of the nozzle-side rib 151*d*, which is formed at the refrigerant injection opening 151*c* side of the nozzle 151, is progressively decreased toward the downstream side in the flow direction of the refrigerant. Therefore, it is possible to reduce the pressure loss of the refrigerant, which flows in the suction passage 152*h*.

The present invention is not limited to the above embodiment, and the above embodiment may be modified as follows without departing from the scope and spirit of the present invention.

(1) In the above embodiment, the nozzle 151 and the body 152 are both formed through the press working, process. However, as long as at least one of the nozzle 151 and the body 152 is formed through the press working process, it is possible to provide the ejector that is suitable for the mass production, which enables the reduction of the manufacturing costs and the reduction of the manufacturing time while allowing a wide variety of applications of the ejector.

(2) In the above embodiment, the ejector 15 is applied in the ejector refrigeration cycle 10. However, the present invention is not limited to this application. For example, the ejector of the present invention may be applied to an ejector refrigeration cycle (heat pump cycle) of a refrigeration/freezing system or a cold storage (chiller) system. Also, the ejector of the present invention may be applied to a vacuum pump, which creates a vacuum through use of a negative pressure that is generated at the fluid suction opening (the refrigerant suction opening 152*c*).

Furthermore, in the above embodiment, the refrigerant of the ejector refrigeration cycle 10 is not specified. However, the refrigerant of the above embodiment may be, for example, regular chlorofluorocarbon refrigerant, hydrocarbon refrigerant or carbon dioxide refrigerant. Furthermore, the ejector refrigeration cycle may be formed as a supercritical refrigeration cycle, in which the pressure of the refrigerant at the output of the compressor 11 is higher than a critical pressure of the refrigerant.

Furthermore, in the above embodiment, the ejector 15 is integrated with the branch portion 14, the outflow-side evaporator 16, the fixed choke 17 and the suction-side evaporator 18 to form the evaporator unit 20. At the time of integrating these components, the radially outermost part (radially outermost surface, i.e., radially outer end surface) of the body-side ribs 152*e* may be used to form brazing surfaces, which are brazed to the inner peripheral surface of the corresponding distribution/collection tank or the separate tank. Furthermore, the ejector 15 may not need to be integrated in the evaporator unit 20, i.e., may be formed separately from the evaporator unit 20.

(3) In the above embodiment, the nozzle preform 41 is the cylindrical tubular body made through the deep-drawing process of the planar metal plate. Alternatively, the nozzle preform 41 may be a tube (tubing) made of metal (e.g., stainless alloy). Furthermore, in the above embodiment, the body preform 42 is the tube (tubing). Alternatively, the body preform 42 may be a tubular body made through a deep-drawing process of a planar metal plate (e.g., a planar aluminum metal plate).

(4) In the above embodiment, the manufacturing sequence of the manufacturing of the nozzle 151 and the manufacturing of the body 152 is not specified. In other words, it is not specified which one of the manufacturing of the nozzle 151 and the manufacturing of the body 152 is performed first in the above embodiment. However, since the nozzle 151 and the body 152 can be independently manufactured, the manufacturing sequence of the manufacturing of the nozzle 151 and the manufacturing of the body 152 can be set in any appropriate manner. That is, any one of the manufacturing of the nozzle 151 and the manufacturing of the body 152 may be performed before the other one, or the manufacturing of the nozzle 151 and the manufacturing of the body 152 may be performed simultaneously.

(5) In the above embodiment, there are provided the cylindrical tubular nozzle. 151 having the two nozzle-side ribs 151*d* and the cylindrical tubular body 152 having the four body-side ribs 152*e*. However, the configuration of the nozzle 151 and the configuration of the body 52 are not limited to these ones.

Figure 8A:
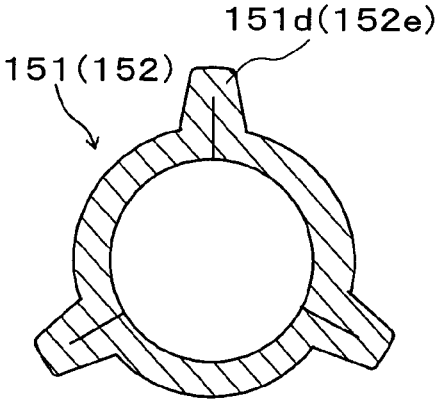
FIGS. 8A to 8D are cross-sectional views of nozzles or the bodies in modifications of the embodiment.
Figure 8B:
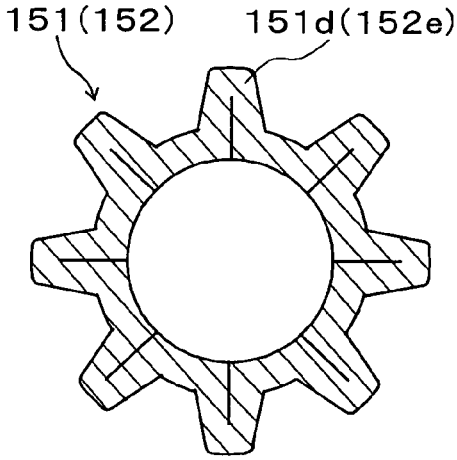
Figure 8C:
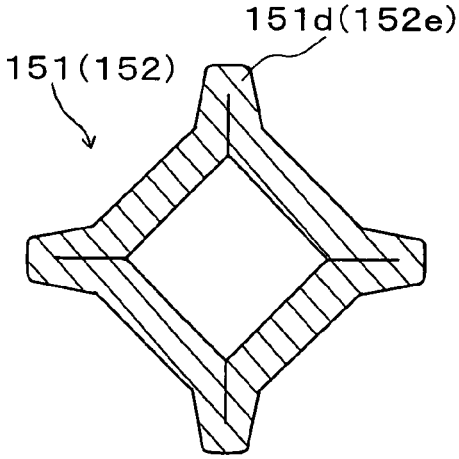
Figure 8D:
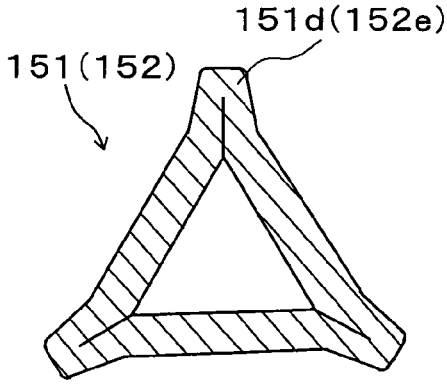

For instance, the number of the nozzle-side ribs 151*d* and the number of the body-side ribs 152*e* may be changed in a manner shown in FIG. 8A or 8B. Specifically, the number of the nozzle-side ribs 151*d* or the body-side ribs 152*e* is three in FIG. 8A, and the number of the nozzle-side ribs 151*d* or the body-side ribs 152*e* is eight in FIG. 8B. In such an instance, it is desirable that the number of the press dies 61 or the press dies 62 is the same as the number of the nozzle-side ribs 151*d* or the body-side ribs 152*e*. Furthermore, the cross-sectional shape of the nozzle 151 and the cross-sectional shape of the body 152 are not limited to the above described ones (circular cross sections). For instance, as shown in FIGS. 8C and 8D, the cross-sectional shape of the nozzle 151 and the cross-sectional shape of the body 152 may be changed to polygonal shapes. Specifically, the cross-sectional shape of the nozzle 151 or the cross-sectional shape of the body 152 is generally in a quadrangular shape in FIG. 8C, and the cross-sectional shape of the nozzle 151 or the cross-sectional shape of the body 152 is generally in a triangular shape in FIG. 8D.

Here, it should be noted that FIGS. 8A to 8D are diagrams showing cross sections of the nozzle 151 or the body 152 and correspond to FIG. 3 or FIG. 4 of the above embodiment.

Additional advantages and modifications will readily occur to those skilled in the art. The invention in its broader terms is therefore not limited to the specific details, representative apparatus, and illustrative examples shown and described.

What is claimed is:

1. An ejector comprising:

a nozzle that is adapted to depressurize and inject fluid, which is supplied to the nozzle; and a body that includes:

a fluid suction opening that is adapted to draw fluid by an action of the injected fluid, which is injected at a high velocity from the nozzle; and a pressurizing portion that is adapted to mix the injected fluid, which is injected from the nozzle, and the drawn fluid, which is drawn through the fluid suction opening, such that a mixture of the injected fluid and the drawn fluid is pressurized through the pressurizing portion, wherein:

at least one of the nozzle and the body is made of metal and is formed by press working;

the at least one of the nozzle and the body, which is formed by the press working, has a rib that is formed integrally with the at least one of the nozzle and the body, and the rib extends in an axial direction of the nozzle and projects radially outward;

the rib has two circumferentially opposed contact surfaces, an outer surface and two side portions, where the two circumferentially opposed contact surfaces extend radially outwardly from an inner peripheral surface of the at least one of the nozzle and the body and are circumferentially urged against each other and are held stationary;

in a predetermined cross section of the at least one of the nozzle and the body, which is perpendicular to the axial direction of the nozzle and includes the rib, the at least one of the nozzle and the body is formed seamlessly as a continuous single piece member;

where at the predetermined cross section the two circumferentially opposed contact surfaces are in permanent contact with each other over a radial distance delimited from the inner peripheral surface of the at least one of the nozzle and the body to a point radially inward from the outer surface of the rib.

2. The ejector according to claim 1, wherein a shape of the rib in the predetermined cross section of the at least one of the nozzle and the body is set such that a circumferential width of the rib progressively decreases toward a radially outer end of the rib.

3. The ejector according to claim 1, wherein:

the body is formed by the press working;

a receiving space, which receives the nozzle, and a pressurizing space, which forms the pressurizing portion, are formed in an inside of the body;

a downstream side portion of the receiving space, which is located at a downstream side in a flow direction of the fluid, converges such that a cross section of the downstream side portion of the receiving space, which is perpendicular to the axial direction, progressively decreases in the flow direction of the fluid;

an upstream side portion of the pressurizing space, which is located at an upstream side in the flow direction of the fluid, diverges such that a cross section of the upstream side portion of the pressurizing space, which is perpendicular to the axial direction, progressively increases in the flow direction of the fluid; and a straight portion, which has a fluid passage cross section that is generally constant along an axial length of the straight portion, is formed in a connecting portion, which connects between the downstream side portion of the receiving space and the upstream side portion of the pressurizing space in the body.

4. The ejector according to claim 1, wherein the at least one of the nozzle and the body is formed by the press working of a cylindrical tubular preform, which is preformed from a planar metal plate by deep-drawing.

5. The ejector according to claim 1, wherein:

the body is formed by the press working; and the fluid suction opening is circumferentially placed at a location, which does not overlap with the rib, which is formed in the body, when the body is viewed in the axial direction.

6. The ejector according to claim 1, wherein:

the nozzle is formed by the press working; and the rib, which is formed integrally with the nozzle, is circumferentially placed at a location, which overlaps with an imaginary radial line that radially connects between a central axis of the nozzle and a circumferential center of the fluid suction opening of the body, when the body is viewed in the axial direction.

7. The ejector according to claim 1, wherein:

the nozzle is formed by the press working; and a radially outermost part of the rib, which is formed integrally with the nozzle, is located radially inward of a radially outermost part of the nozzle.

8. The ejector according to claim 1, wherein:

the nozzle is formed by the press working; and the rib, which is formed integrally with the nozzle, has a downstream side portion, which is located adjacent to a fluid injection opening of the nozzle and has a radial height that progressively decreases in a flow direction of the fluid.

9. The ejector according to claim 1, wherein the rib is one of a plurality of ribs, which are formed in the at least one of the nozzle and the body by the press working and are arranged one after another at generally equal intervals in a circumferential direction.

10. The ejector according to claim 1, wherein the two circumferentially opposed contact surfaces of the rib do not form a passage for the fluid which is supplied to the nozzle.

11. The ejector according to claim 1, wherein the two opposed contact surfaces extend from a position open to an internal chamber defined by the at least one of the nozzle and the body.

12. The ejector according to claim 1, wherein the two opposed contact surfaces extend from a position adjacent the inner peripheral surface.

13. The ejector according to claim 1, wherein the two opposed contact surfaces extend from a position radially outward from the inner peripheral surface.

* * * * *